US005805964A

United States Patent [19]

Badesha et al.

[11] Patent Number: 5,805,964

[45] Date of Patent: Sep. 8, 1998

[54] INORGANIC COATED DEVELOPMENT ELECTRODES AND METHODS THEREOF

[75] Inventors: Santokh S. Badesha; Arnold W. Henry, both of Pittsford; George J. Heeks; J. Stephen Kittelberger, both of Rochester; John G. VanDusen, Walworth; Suresh K. Ahuja, Webster; Merlin E. Scharfe, Penfield; Richard L. Schank, Pittsford; Mark J. Hirsch, Fairport, all of N.Y.

[73] Assignee: Xerox Corporation, Stamford, Conn.

[21] Appl. No.: 841,234

[22] Filed: Apr. 29, 1997

[51] Int. Cl.[6] ..... G03G 15/06

[52] U.S. Cl. ..... 399/266; 399/290

[58] Field of Search ..... 399/266, 290, 399/291

[56] References Cited

U.S. PATENT DOCUMENTS

| | | | |
|---|---|---|---|
| 4,868,600 | 9/1989 | Hays et al. | 355/259 |
| 4,984,019 | 1/1991 | Folkins | 355/215 |
| 5,010,368 | 4/1991 | O'Brien | 399/266 |
| 5,124,749 | 6/1992 | Bares | 355/202 |
| 5,172,170 | 12/1992 | Hays et al. | 355/259 |
| 5,270,782 | 12/1993 | Floyd, Jr. | 399/266 |
| 5,300,339 | 4/1994 | Hays et al. | 428/36.9 |
| 5,311,258 | 5/1994 | Brewington et al. | 399/266 |
| 5,448,342 | 9/1995 | Hays et al. | 355/259 |

OTHER PUBLICATIONS

Xerox Disclosure Journal, vol. 14, No. 1, Jan./Feb. 1989 entitled "Metal Cleaning Blade with Diamond Coating", by Paul F. Morgan.

*Primary Examiner*—Arthur T. Grimley
*Assistant Examiner*—Quana Grainger
*Attorney, Agent, or Firm*—Annette L. Bade

[57] ABSTRACT

An apparatus and process for reducing accumulation of toner from the surface of an electrode member in a development unit of an electrostatographic printing apparatus by providing an inorganic coating on at least a portion of the electrode member.

20 Claims, 3 Drawing Sheets

INORGANIC COATED DEVELOPMENT ELECTRODES AND METHODS THEREOF

CROSS REFERENCE TO RELATED APPLICATIONS

Attention is directed to the following copending applications assigned to the assignee of the present application: Attorney Docket No. D/96244, U.S. application Ser. No. 08/841,033 filed Apr. 29, 1997, entitled, "Coated Development Electrodes and Methods Thereof;" Attorney Docket No. D/96244Q1, U.S. application Ser. No. 08/841,136 filed Apr. 29, 1997, entitled, "Organic Coated Development Electrodes and Methods Thereof;" Attorney Docket No. D/96244Q3, U.S. application Ser. No. 08/841,034 filed Apr. 29, 1997, entitled, "Composite Coated Development Electrodes and Methods Thereof;" and Attorney Docket No. D/96244Q4, U.S. application Ser. No. 08/841,235 filed Apr. 29, 1997, entitled "Coating Compositions for Development Electrodes and Methods Thereof." The disclosures of each of these applications are hereby incorporated by reference in their entirety.

BACKGROUND OF THE INVENTION

The present invention relates to methods, processes and apparatii for development of images, and more specifically, to electrode members for use in a developer unit in electrophotographic printing machines. Specifically, the present invention relates to methods and apparatii in which at least a portion of a development unit electrode member is coated with a coating material, and in embodiments, a low surface energy coating material. In embodiments, electrode member history, damping and/or toner accumulation is controlled or reduced.

Generally, the process of electrophotographic printing includes charging a photoconductive member to a substantially uniform potential so as to sensitize the photoconductive member thereof. The charged portion of the photoconductive member is exposed to a light image of an original document being reproduced. This records an electrostatic latent image on the photoconductive member. After the electrostatic latent image is recorded on the photoconductive member, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of single component development system is a scavengeless development system that uses a donor roll for transporting charged toner to the development zone. At least one, and preferably a plurality of electrode members are closely spaced to the donor roll in the development zone. An AC voltage is applied to the electrode members forming a toner cloud in the development zone. The electrostatic fields generated by the latent image attract toner from the toner cloud to develop the latent image.

Another type of two component development system is a hybrid scavengeless development system which employs a magnetic brush developer roller for transporting carrier having toner adhering triboelectrically thereto. A donor roll is used in this configuration also to transport charged toner to the development zone. The donor roll and magnetic roller are electrically biased relative to one another. Toner is attracted to the donor roll from the magnetic roll. The electrically biased electrode members detach the toner from the donor roll forming a toner powder cloud in the development zone, and the latent image attracts the toner particles thereto. In this way, the latent image recorded on the photoconductive member is developed with toner particles.

Various types of development systems have hereinbefore been used as illustrated by the following disclosures.

U.S. Pat. No. 4,868,600 to Hays et al., the subject matter of which is hereby incorporated by reference in its entirety, describes an apparatus wherein a donor roll transports toner to a region opposed from a surface on which a latent image is recorded. A pair of electrode members are positioned in the space between the latent image surface and the donor roll and are electrically biased to detach toner from the donor roll to form a toner cloud. Detached toner from the cloud develops the latent image.

U.S. Pat. No. 4,984,019, to Folkins, the subject matter of which is hereby incorporated by reference in its entirety, discloses a developer unit having a donor roll with electrode members disposed adjacent thereto in a development zone. A magnetic roller transports developer material to the donor roll. Toner particles are attracted from the magnetic roller to the donor roller. When the developer unit is inactivated, the electrode members are vibrated to remove contaminants therefrom.

U.S. Pat. No. 5,124,749 to Bares, the subject matter of which is hereby incorporated by reference in its entirety, discloses an apparatus in which a donor roll advances toner to an electrostatic latent image recorded on a photoconductive member wherein a plurality of electrode wires are positioned in the space between the donor roll and the photoconductive member. The wires are electrically biased to detach the toner from the donor roll so as to form a toner cloud in the space between the electrode wires and the photoconductive member. The powder cloud develops the latent image. A damping material is coated on a portion of the electrode wires at the position of attachment to the electrode supporting members for the purpose of damping vibration of the electrode wires.

U.S. Pat. Nos. 5,300,339 and 5,448,342 both to Hays et al., the subject matter each of which is hereby incorporated by reference in their entirety, disclose a coated toner transport roll containing a core with a coating thereover.

U.S. Pat. No. 5,172,170 to Hays et al., the subject matter of which is hereby incorporated by reference in its entirety, discloses an apparatus in which a donor roll advances toner to an electrostatic latent image recorded on a photoconductive member. The donor roll includes a dielectric layer disposed about the circumferential surface of the roll between adjacent grooves.

Primarily because the adhesion force of the toner particles is greater than the stripping force generated by the electric field of the electrode members in the development zone, a problem results in that toner tends to build up on the electrode members. Accumulation of toner particles on the wire member causes non-uniform development of the latent image, resulting in print defects. The problem is aggravated by toner fines and any toner components, such as high molecular weight, crosslinked and/or branched components, and the voltage breakdown between the wire member and the donor roll.

One specific example of toner contamination results upon development of a document having solid areas which require a large concentration of toner to be deposited at a particular position on the latent image. The areas of the electrode member corresponding to the high throughput or high toner concentration areas tend to include higher or lower accumulation of toner because of this differing exposure to toner throughput. When the printer subsequently attempts to develop another, different image, the toner accumulation on the electrode member will lead to differential development of the newly developed image corresponding to the areas of greater or lesser toner accumulation on the electrode members. The result is a darkened or lightened band in the position corresponding to the solid area of the previous image. This is particularly evident in areas of intermediate density, since these are the areas most sensitive to differences in development. These particular image defects caused by toner accumulation on the electrode wires at the development zone are referred to as wire history. FIG. 5 contains an illustration of wire contamination and wire history. Wire contamination results when fused toner forms between the electrode member and donor member due to toner fines and any toner components, such as high molecular weight, crosslinked and/or branched components, and the voltage breakdown between the wire member and the donor roll. Wire history is a change in developability due to toner or toner components sticking to the top of the electrode member.

Accordingly, there is a specific need for electrode members in the development zone of a development unit of an electrophotographic printing machine which provide for a decreased tendency for toner accumulation in order to decrease wire history and wire contamination, especially at high throughput areas, and decreasing the production of unwanted surface static charges from which contaminants may not release. One possible solution is to change the electrical properties of the wire. However, attempts at decreasing toner build-up on the development wire by changing the electrical properties thereof, may result in an interference with the function of the wire and its ability to produce the formation of the toner powder cloud. Therefore, there is a specific need for electrode members which have a decreased tendency to accumulate toner and which also retain their electrical properties in order to prevent interference with the functioning thereof. There is an additional need for electrode members which have superior mechanical properties including durability against severe wear the electrode member receives when it is repeatedly brought into contact with tough rotating donor member surfaces.

SUMMARY OF THE INVENTION

Examples of objects of the present invention include:

It is an object of the present invention to provide an apparatus for reducing toner accumulation of electrode members in the development zone of a developing unit in an electrophotographic printing apparatus with many of the advantages indicated herein.

Another object of the present invention is to provide an apparatus for reducing toner adhesion to electrode members.

It is another object of the present invention to provide an apparatus comprising electrode members having a lower surface energy.

It is yet another object of the present invention to provide an apparatus comprising electrode members having increased mechanical strength.

Still yet another object of the present invention is to provide an apparatus comprising electrode members which have superior electrical properties.

A further object of the present invention is to provide an apparatus comprising electrode members which have smooth surfaces.

Many of the above objects have been met by the present invention, in embodiments, which includes: an apparatus for developing a latent image recorded on a surface, comprising: wire supports; a donor member spaced from the surface and being adapted to transport toner to a region opposed from the surface; an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and an inorganic coating on at least a portion of nonattached regions of said electrode member.

Embodiments further include: an electrophotographic process comprising: a) forming an electrostatic latent image on a charge-retentive surface; b) applying toner in the form of a toner cloud to said latent image to form a developed image on said charge retentive surface, wherein said toner is applied using a development apparatus comprising wire supports; a donor member spaced from the surface and being adapted to transport toner to a region opposed from the surface; an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image, wherein opposed end regions of said electrode member are attached to said wire supports adapted to support the opposed end regions of said electrode member; and an inorganic coating on at least a portion of nonattached regions of said electrode member; c) transferring the toner image from said charge-retentive surface to a substrate; and d) fixing said toner image to said substrate.

The present invention provides electrode members which, in embodiments, have a decreased tendency to accumulate toner and which also, in embodiments, retain their electrical properties in order to prevent interference with the functioning thereof. The present invention further provides electrode members which, in embodiments, have superior mechanical properties including durability against severe wear the electrode member receives when it is repeatedly brought into contact with tough rotating donor roll surfaces.

BRIEF DESCRIPTION OF THE DRAWINGS

The above aspects of the present invention will become apparent as the following description proceeds upon reference to the drawings in which.

DETAILED DESCRIPTION

For a general understanding of the features of the present invention, a description thereof will be made with reference to the drawings.

Figure 1:
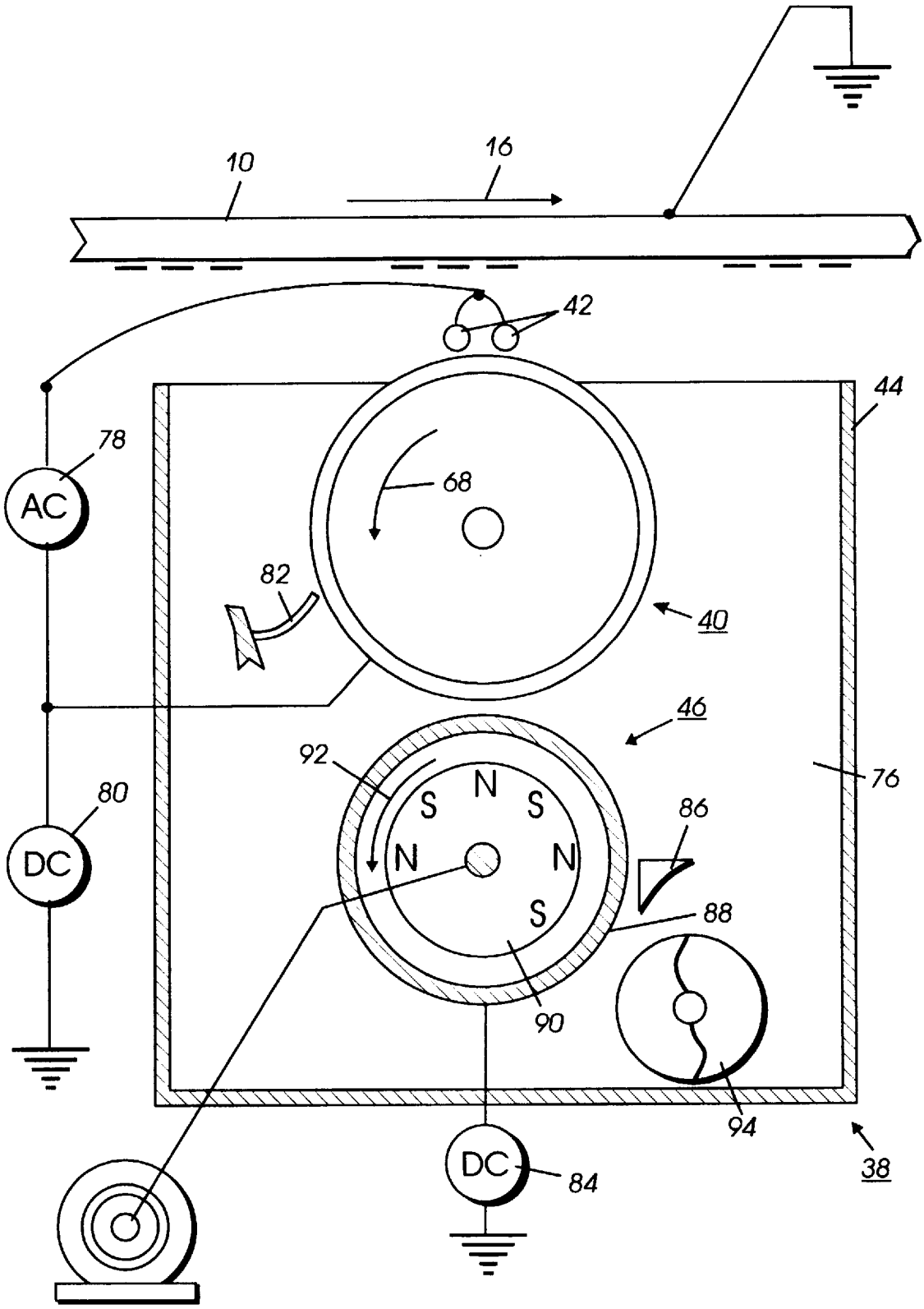
FIG. 1 is a schematic illustration of an embodiment of a development apparatus useful in an electrophotographic printing machine.

FIG. 1 shows a development apparatus used in an electrophotographic printing machine such as that illustrated and described in U.S. Pat. No. 5,124,749, the disclosure of which is hereby incorporated by reference in its entirety. This patent describes the details of the main components of an electrophotographic printing machine and how these components interact. The present application will concentrate on the development unit of the electrophotographic printing machine. Specifically, after an electrostatic latent image has been recorded on a photoconductive surface, a photoreceptor belt advances the latent image to the development station. At the development station, a developer unit develops the latent image recorded on the photoconductive surface.

Referring now to FIG. 1, in a preferred embodiment of the invention, developer unit 38 develops the latent image recorded on the photoconductive surface 10. Preferably, developer unit 38 includes donor roller 40 and electrode member or members 42. Electrode members 42 are electrically biased relative to donor roll 40 to detach toner therefrom so as to form a toner powder cloud in the gap between the donor roll 40 and photoconductive surface 10. The latent image attracts toner particles from the toner powder cloud forming a toner powder image thereon. Donor roller 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller 46 disposed interior of the chamber of housing 44 conveys the developer material to the donor roller 40. The magnetic roller 46 is electrically biased relative to the donor roller so that the toner particles are attracted from the magnetic roller to the donor roller.

More specifically, developer unit 38 includes a housing 44 defining a chamber 76 for storing a supply of two component (toner and carrier) developer material therein. Donor roller 40, electrode members 42 and magnetic roller 46 are mounted in chamber 76 of housing 44. The donor roller can be rotated in either the 'with' or 'against' direction relative to the direction of motion of belt 10. In FIG. 1, donor roller 40 is shown rotating in the direction of arrow 68. Similarly, the magnetic roller can be rotated in either the 'with' or 'against' direction relative to the direction of motion of belt 10. In FIG. 1, magnetic roller 46 is shown rotating in the direction of arrow 92. Donor roller 40 is preferably made from anodized aluminum or ceramic.

Developer unit 38 also has electrode members 42 which are disposed in the space between the belt 10 and donor roller 40. A pair of electrode members are shown extending in a direction substantially parallel to the longitudinal axis of the donor roller. The electrode members are made from of one or more thin (i.e., 50 to 100 $\mu$m in diameter) stainless steel or tungsten electrode members which are closely spaced from donor roller 40. The distance between the electrode members and the donor roller is from about 5 to about 35 $\mu$m, preferably about 10 to about 25 $\mu$m or the thickness of the toner layer on the donor roll. The electrode members are self-spaced from the donor roller by the thickness of the toner on the donor roller. To this end, the extremities of the electrode members supported by the tops of end bearing blocks also support the donor roller for rotation. The electrode member extremities are attached so that they are slightly above a tangent to the surface, including toner layer, of the donor structure. Mounting the electrode members in such a manner makes them insensitive to roll run-out due to their self-spacing.

As illustrated in FIG. 1, an alternating electrical bias is applied to the electrode members by an AC voltage source 78. The applied AC establishes an alternating electrostatic field between the electrode members and the donor roller is effective in detaching toner from the photoconductive member of the donor roller and forming a toner cloud about the electrode members, the height of the cloud being such as not to be substantially in contact with the belt 10. The magnitude of the AC voltage is relatively low and is in the order of 200 to 500 volts peak at a frequency ranging from about 9 kHz to about 15 kHz. A DC bias supply 80 which applies approximately 300 volts to donor roller 40 establishes an electrostatic field between photoconductive member of belt 10 and donor roller 40 for attracting the detached toner particles from the cloud surrounding the electrode members to the latent image recorded on the photoconductive member. At a spacing ranging from about 0.001 $\mu$m to about 45 $\mu$m between the electrode members and donor roller, an applied voltage of 200 to 500 volts produces a relatively large electrostatic field without risk of air breakdown. A cleaning blade 82 strips all of the toner from donor roller 40 after development so that magnetic roller 46 meters fresh toner to a clean donor roller. Magnetic roller 46 meters a constant quantity of toner having a substantially constant charge onto donor roller 40. This insures that the donor roller provides a constant amount of toner having a substantially constant charge in the development gap. In lieu of using a cleaning blade, the combination of donor roller spacing, i.e., spacing between the donor roller and the magnetic roller, the compressed pile height of the developer material on the magnetic roller, and the magnetic properties of the magnetic roller in conjunction with the use of a conductive, magnetic developer material achieves the deposition of a constant quantity of toner having a substantially charge on the donor roller. A DC bias supply 84 which applies approximately 100 volts to magnetic roller 46 establishes an electrostatic field between magnetic roller 46 and donor roller 40 so that an electrostatic field is established between the donor roller and the magnetic roller which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface thereof roughened. An elongated magnet 90 is positioned interiorly of and spaced from the tubular member. The magnet is mounted stationarily. The tubular member rotates in the direction of arrow 92 to advance the developer material adhering thereto into the nip defined by donor roller 40 and magnetic roller 46. Toner particles are attracted from the carrier granules on the magnetic roller to the donor roller.

With continued reference to FIG. 1, an auger, indicated generally by the reference numeral 94, is located in chamber 76 of housing 44. Auger 94 is mounted rotatably in chamber 76 to mix and transport developer material. The auger has blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles which may include toner and carrier particles. The toner dispenser is in communication with chamber 76 of housing 44. As the concentration of toner particles in the developer material is decreased, fresh toner particles are furnished to the developer material in the chamber from the toner dispenser. In an embodiment of the invention, the auger in the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, in an embodiment of the invention wherein the toner includes carrier particles, the carrier granules include a ferromagnetic core having a thin layer of magnetite overcoated with a noncontinuous layer of resinous material. The toner particles may be made from a resinous material, such as a vinyl polymer, mixed with a coloring material, such as chromogen black. The developer material may comprise from about 90% to about 99% by weight of carrier and from 10% to about 1% by weight of toner. However, one skilled in the art will recognize that any other suitable developer material may be used.

In an alternative embodiment of the present invention, one component developer material consisting of toner without carrier may be used. In this configuration, the magnetic roller 46 is not present in the developer housing . This embodiment is described in more detail in U.S. Pat. No. 4,868,600, the disclosure of which is hereby incorporated by reference in its entirety.

Figure 2:
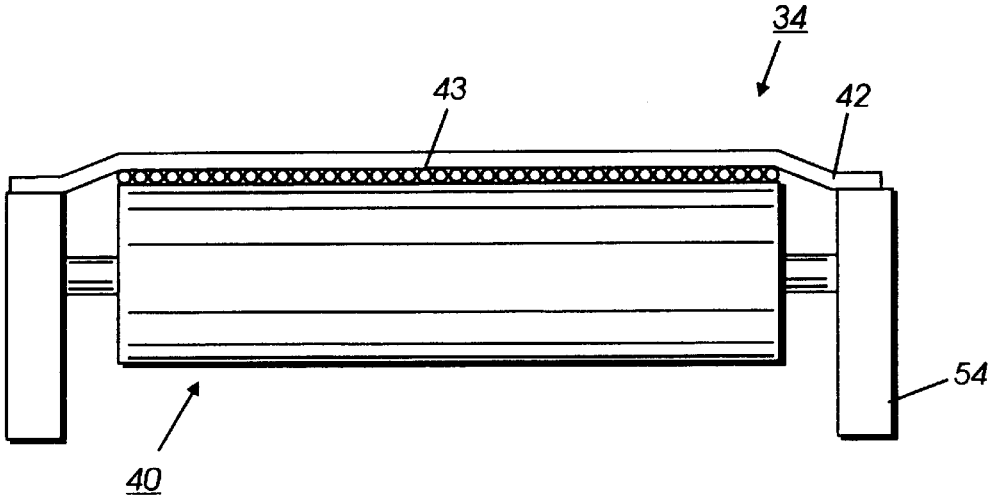
FIG. 2 is an enlarged, schematic illustration of a donor roll and electrode member representing an embodiment of the present invention.

An embodiment of the developer unit is further depicted in FIG. 2. The developer apparatus 34 comprises an electrode member 42 which is disposed in the space between the photoreceptor (not shown in FIG. 2) and the donor roll 40. The electrode 42 can be comprised of one or more thin (i.e., 50 to about 100 $\mu$m in diameter) tungsten or stainless steel electrode members which are lightly positioned at or near the donor structure 40. The electrode member is closely spaced from the donor member. The distance between the wire(s) and the donor is approximately 0.001 to about 45 $\mu$m, and preferably from about 10 to about 25 $\mu$m or the thickness of the toner layer 43 on the donor roll. The wires as shown in FIG. 2 are self spaced from the donor structure by the thickness of the toner on the donor structure. The extremities or opposed end regions of the electrode member are supported by support members 54 which may also support the donor structure for rotation. In a preferred embodiment, the electrode member extremities or opposed end regions are attached so that they are slightly below a tangent to the surface, including toner layer, of the donor structure. Mounting the electrode members in such a manner makes them insensitive to roll runout due to their self-spacing.

Figure 3:
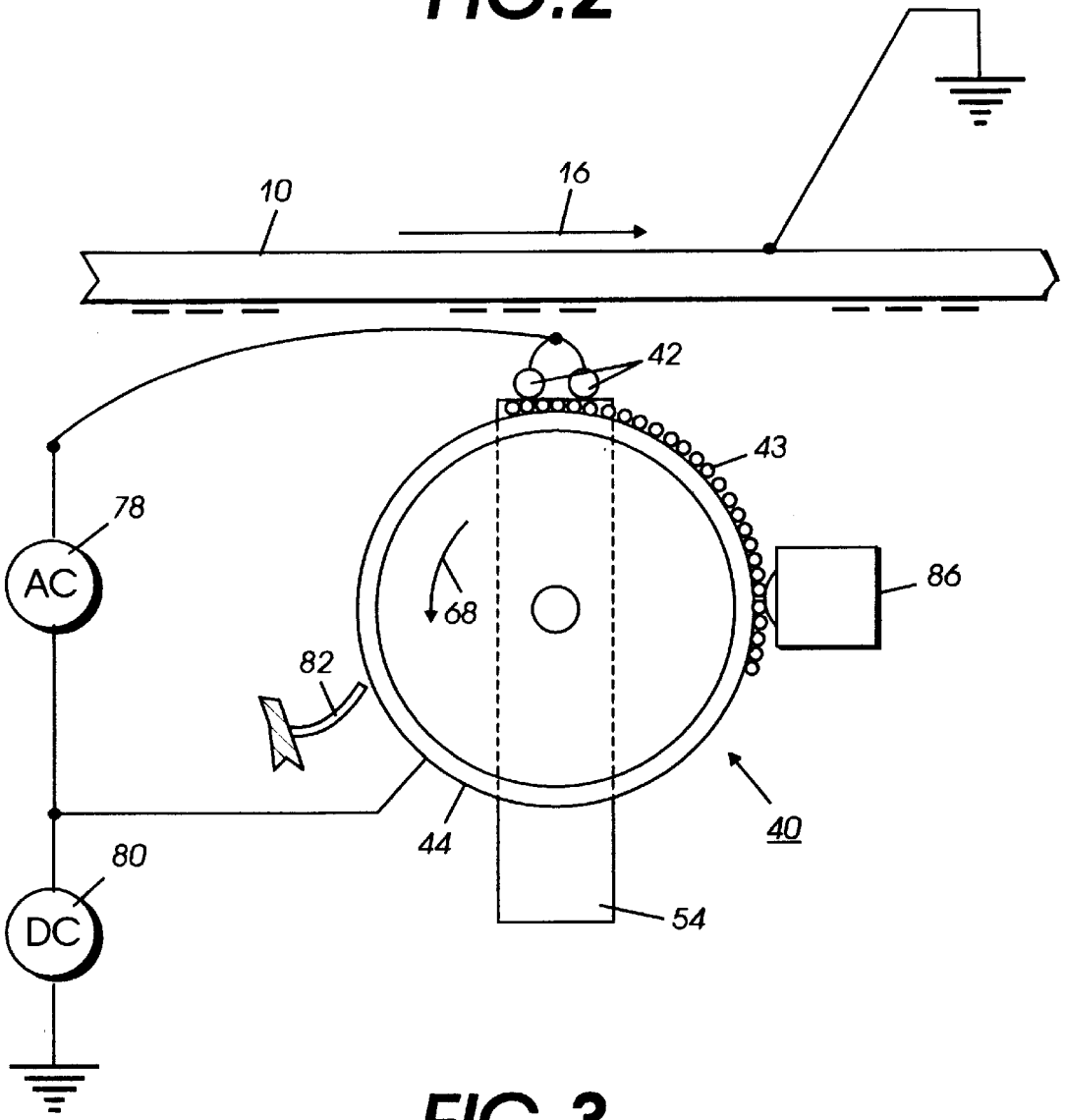
FIG. 3 is a fragmentary schematic illustration of a development housing comprising a donor roll and an electrode member from a different angle than as shown in FIG. 2.

In an alternative embodiment to that depicted in FIG. 1, the metering blade 86 is replaced by a combined metering and charging blade 86 as shown in FIG. 3. The combination metering and charging device may comprise any suitable device for depositing a monolayer of well charged toner onto the donor structure 40. For example, it may comprise an apparatus such as that described in U.S. Pat. No. 4,459,009, wherein the contact between weakly charged toner particles and a triboelectrically active coating contained on a charging roller results in well charged toner. Other combination metering and charging devices may be employed, for example, a conventional magnetic brush used with two component developer could also be used for depositing the toner layer onto the donor structure, or a donor roller alone used with one component developer.

Figure 4:
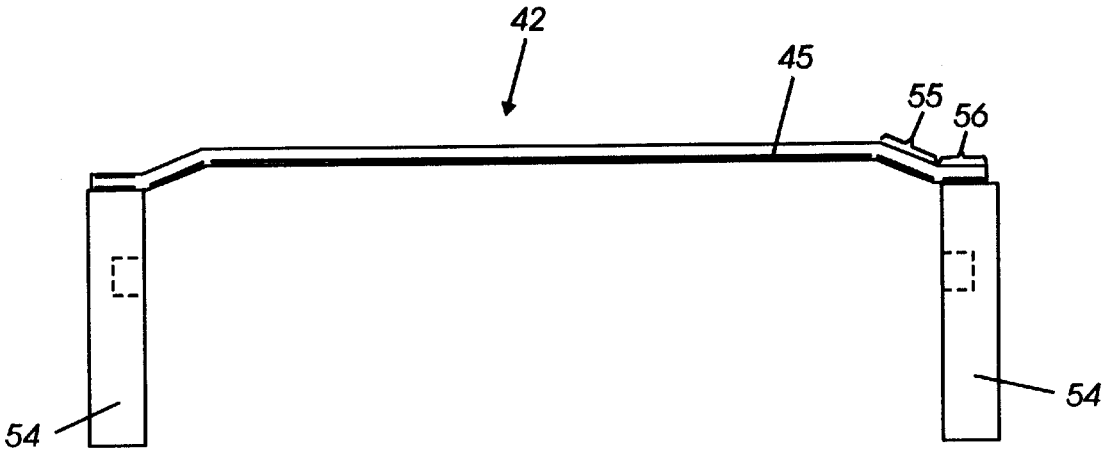
FIG. 4 is an enlarged, schematic illustration of an electrode member supported by mounting means in an embodiment of the present invention.

FIG. 4 depicts an enlarged view of a preferred embodiment of the electrode member of the present invention. Electrode wires 45 are positioned inside electrode member 42. The anchoring portions 55 of the electrode members are the portions of the electrode member which anchor the electrode member to the support member. The mounting sections 56 of the electrode member are the sections of the electrode members between the electrode member and the mounting means 54.

Toner particles are attracted to the electrode members primarily through electrostatic attraction. Toner particles adhere to the electrode members because the adhesion force of the toner is larger than the stripping force generated by the electric field of the electrode member. Generally, the adhesion force between a toner particle and an electrode member is represented by the general expression $F_{ad}=q^2/kr^2+W$, wherein $F_{ad}$ is the force of adhesion, q is the charge on the toner particle, k is the effective dielectric constant of the toner and any dielectric coating, and r is the separation of the particle from its image charge within the wire which depends on the thickness, dielectric constant, and conductivity of the coating. Element W is the force of adhesion due to short range adhesion forces such as van der Waals and capillary forces. The force necessary to strip or remove particles from the electrode member is supplied by the electric field of the wire during half of its AC period, qE, plus effective forces resulting from mechanical motion of the electrode member and from bombardment of the wire by toner in the cloud. Since the adhesion force is quadratic in q, adhesion forces will be larger than stripping forces for sufficiently high values of q.

Figure 5:
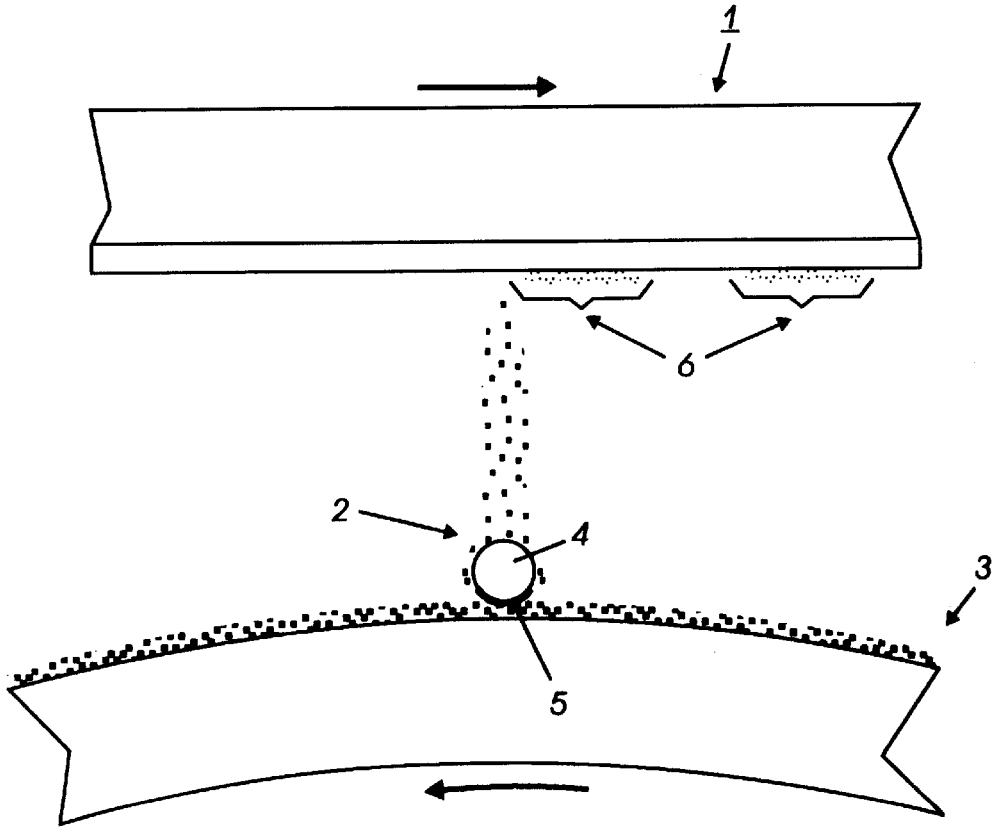
PRIOR ART FIG.5
FIG. 5 is an illustration of wire contamination and wire history.

FIG. 5 contains an illustration of wire contamination and wire history. A photoreceptor 1 is positioned near wire 4 and contains an undeveloped image 6 which is subsequently developed by toner originating from donor member 3. Wire contamination occurs when fused toner 5 forms between the wire 4 and donor member 3. The problem is aggravated by toner fines and any toner components, such as high molecular weight, crosslinked and/or branched components, and the voltage breakdown between the wire member and the donor roll. Wire history is a change in developability due to toner 2 or toner components sticking to the top of the wire 4, the top of the wire being the part of the wire facing the photoreceptor.

In order to prevent the toner defects associated with wire contamination and wire history, the electrical properties of the electrode member can be changed, thereby changing the adhesion forces in relation to the stripping forces. However, such changes in the electrical properties of the electrode member may adversely affect the ability of the electrode member to adequately provide a toner cloud, which is essential for developing a latent image. The present invention is directed to an apparatus for reducing the unacceptable accumulation of toner on the electrode member while maintaining the desired electrical and mechanical properties of the electrode member. The electrode member of the present invention is coated with a material coating that reduces the significant attraction of toner particles to the electrode member which may result in toner accumulation. However, the material coating does not adversely interfere with the mechanical or electrical properties of the electrode member. Materials having these qualities include materials with a low surface energy.

The low surface energy material decreases the accumulation of toner by assuring electrical continuity for charging the wires and eliminates the possibility of charge build-up. In addition, such low surface energy materials as described herein do not interfere with the electrical properties of the electrode member and do not adversely affect the electrode's ability to produce a toner powder cloud. Moreover, the electrode member maintains its tough mechanical properties, allowing the electrode member to remain durable against the severe wear the electrode member receives when it is repeatedly brought into contact with tough, rotating donor roll surfaces. Also, the electrode member maintains a "smooth" surface after the coating is applied. A smooth surface includes surfaces having a surface roughness of less than about 5 microns, preferably from about 0.01 to about 1 micron.

Examples of suitable low surface energy electrode coating materials include both organic materials and inorganic materials. It is preferred that the inorganic material possess the characteristics of low surface energy, high hardness, very low or no porosity, smooth surface characteristics, low friction and high wear resistance to enable the wire to withstand numerous cycling for every day use in an electrophotographic apparatus. Examples of suitable inorganic materials possessing the above characteristics include ceramics, borosilicate glasses, diamond and diamond like compounds, silicone hard coatings, molybdenum silicide, and derivatives thereof. Examples of ceramics having little or no porosity, include boron nitride, zirconium oxide, titanium carbide, silicon carbide, titanium nitride, zirconium diboride, yettrium oxide, glass ceramic (having about 75 percent by weight silica) and the like. Suitable ceramic coating materials are available as stable dispersions from ZYP Coatings Co. of Oak Ridge, Tenn. Heat resistant glass such as, for example, borosilicate glasses, are also suitable inorganic materials and possess the above characteristics. Glass coated wires are commercially available from AMTX Company of Canandaguia, N.Y. and Pegasus of Springfield, Mass. Diamond and diamond derivative coatings including low grade diamonds such as, for example, bort and carbonado, are also suitable low surface inorganics and commercially available examples include "Dylyn Coating" by Advanced Refractory Technologies of Buffalo, N.Y. which is a self compensating interpenetrating network of carbon, hydrogen, silicone and oxygen. Another suitable low surface energy inorganic material is molybdenum suicide ($MoSi_2$) and its combination with silica, both forms of which are commercially available as stable dispersions from ZYP Coatings of Oak Ridge, Tenn. Other suitable low surface energy inorganic materials include hard silicone coatings such as, for example, silanes and siloxanes, which can be deposited on the wire surface by Ion Beam Assisted Deposition method, thereby forming inorganic hard silicone coatings. The details of this technique are published in the Journal of Materials Research, vol. 6, page 871, 1991, the disclosure of which is hereby incorporated by reference in its entirety.

A filler such as an electrically conductive filler, may be added to the material coating in the amount of from about 5 to about 35 percent by weight of total solids, preferably from about 15 to about 20 percent by weight of total solids. Total solids herein include the amount of filler and inorganic solid material, catalyst, and any additives. Examples of electrically conductive fillers include metal oxides such as tin oxide, titanium oxide, zirconium oxide. Another preferred filler is carbon black, graphite or the like, with surface treatment of compounds such as for example, siloxane, silane, fluorine or the like. Specifically preferred treated carbon blacks include fluorinated carbons such as those described in co-pending U.S. patent application Ser. No. 08/635,356 filed Apr. 19, 1996, the disclosure of which is hereby incorporated by reference in its entirety.

The low surface energy inorganic coating material is preferably present in an amount of from about 5 to about 95 percent by weight of total solids, and preferably from about 10 to about 40 percent by weight of total solids. Total solids as used herein, refers to the total amount by weight of inorganic coating material, fillers, and additives contained in the coating solution.

The volume resistivity of the coated electrode is for example from about $10^{-10}$ to about $1^{-1}$ ohm-cm, and preferably from $10^{-5}$ to $10^{-1}$ ohm-cm. The surface roughness is less than about 5 microns and preferably from about 0.01 to about 1 micron.

In a preferred embodiment of the invention, the material coating is coated over at least a portion of the nonattached regions of the electrode member. The nonattached region of the electrode member is the entire outer surface region of the electrode minus the region where the electrode is attached to the mounting means 54 and minus the anchoring area (55 in FIG. 4). It is preferred that the coating cover the portion of the electrode member which is adjacent to the donor roll. In another preferred embodiment of the invention, the material coating is coated in an entire area of the electrode member located in a central portion of the electrode member and extending to an area adjacent to the nonattached portion of the electrode member. This area includes the entire surface of the electrode member minus the anchoring area (55 in FIG. 4). In an alternative embodiment, the entire length of the electrode member is coated with the material coating, including the anchoring area 55 and mounting area 56. In embodiments, at least a portion refers to the non-attached region being coated, or from about 10 to about 90 percent of the electrode member.

Toner can accumulate anywhere along the electrode member, but it will not adversely affect development unless it accumulates in the length of the electrode member near to the donor roll or on the length closest to the photoreceptor. Therefore, it is preferred that the material coating cover the electrode member along the entire length corresponding to the donor roll, and on the entire length corresponding to the photoreceptor.

The material coating may be deposited on at least a portion of the electrode member by any suitable, known method. These deposition methods include liquid and powder coating, dip and spray coating, and ion beam assisted and RF plasma deposition. In a preferred deposition method, the material coating is coated on the electrode member by dip coating. With silicone materials, it is preferred to apply these coatings by ion beam assisted deposition. After coating, the inorganic coating is preferably air dried and cured at a temperature suitable for curing the specific inorganic material. Curing temperatures range from about 400 to about 1400° C., and preferably from about 600 to about 1200° C.

The average thickness of the coating is from about 1 to about 30 $\mu$m thick, and preferably from about 2 to about 10 $\mu$m thick. If the coating is applied to only a portion of the electrode member, the thickness of the coating may or may not taper off at points farthest from the midpoint of the electrode member. Therefore, the thickness of the coating may decrease at points farther away from the midpoint of the electrode.

The electrode members of the present invention, the embodiments of which have been described herein exhibit superior performance in terms wear resistance and decreased accumulation of toner on the surface of the electrode member, while also maintaining electrical properties which stimulate production of powder cloud development without charge build-up. In addition, the electrode members herein exhibit superior mechanical properties such as durability against donor roll surfaces which are normally made of tough materials such as ceramics.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Preparation of Wire to be Coated

A stainless steel wire of about 3 mil thickness is preferably cleaned to remove obvious contaminants.

A dip coating apparatus with a 1 inch (diameter) by 15 inches (length) glass cylinder sealed at one end to hold the liquid coating material can be used for dip coating the wire. A cable attached to a Bodine Electric Company type NSH-12R motor is used to raise and lower a wire support holder that keeps the wire taut during the coating process. The dip and withdraw rate of the wire holder into and out of the coating solution can be regulated by a motor control device from B&B Motors & Control Corporation, (NOVA PD DC motor speed control). After coating, a motor driven device is used to twirl the wire around its axis while it receives external heating to allow for controlled solvent evaporation. When the coating is dry and/or non-flowable, the coated wire can be heated in a flow through oven using a time and temperature schedule to complete either drying or cure/post cure of the coating.

The general procedure may include: (A) cleaning and degreasing the wire with an appropriate solvent, for example, acetone, alcohol or water, and roughened if necessary by, for example, sand paper; (B) the coating material may be adjusted to the proper viscosity and solids content by adding solids or solvent to the solution; and (C) the wire is dipped into and withdrawn from the coating solution, dried and cured/post cured, if necessary, and dipped again, if required. The coating thickness and uniformity are a function of withdrawal rate and solution viscosity, (solids content in most solvent based systems) and a drying schedule consistent with the uniform solidification of the coating.

EXAMPLES

Preparation of Inorganic Coating Solutions

Example 1

A stainless steel wire of 3 mil thickness can be cleaned to remove obvious contaminants. High purity titanium nitride (TiN) dispersion Type "TN" obtained from ZYP Coatings Inc., of Oak Ridge, Tenn., having 75% solids content is then added to the coating tank of the dip coater. This coating can be applied using conventional dip coating method as described in Example 1. The coatings can then be air dried and cured at 400° C. for 12 hours. The resulting coating surface can then be hand polished through a rubbing action by using a back and forth wiping motion.

Example 2

A dispersion containing zirconium diboride obtained from ZYP Coatings Inc, of Oak Ridge, Tenn. as Type "ZB-MOD" having 58% solids contents can be used as an inorganic coating solution. This coating can be applied using conventional dip coating method as described in Example 1. The coatings can then be air dried and cured at 1,200°–1,600° C.

Example 3

A dispersion of molybdenum disilicide obtained from ZYP Coatings Inc, of Oak Ridge, Tenn. sold as Type "MS" having about 50% solids can be used as an inorganic coating. This coating can be applied using conventional dip coating method as described in Example 1. The coatings can then be air dried and cured at 1,200°–1,600° C.

Example 4

A dispersion of boron nitride obtained from ZYP Coatings Inc, of Oak Ridge, Tenn. sold as Type "BN-MOD" and having about 25% solids can be used as an inorganic coating. This coating can be applied using conventional dip coating method as described in Example 1. The coatings can then be air dried and cured at 700°–1,000° C.

Example 5

A dispersion of titanium carbide obtained from ZYP Coatings Inc, of Oak Ridge, Tenn. sold as Type "T" and having about 45% solids can be used as an inorganic coating. This coating can be applied using conventional dip coating method as described in Example 1. The coatings can then be air dried and cured at 700°–900° C.

Example 6

A steel wire can be coated by Advanced Refractory Technology of Buffalo, N.Y. with self compensating interpenetrating network of carbon, hydrogen, silicone and oxygen which is commercially called "Dylyn". The thickness of the coating is estimated to be from about 1 to about 3 microns, very smooth and relatively hard. The electrical conductivity is estimated to be about $10^{-9}$ ohm-cm.

While the invention has been described in detail with reference to specific and preferred embodiments, it will be appreciated that various modifications and variations will be apparent to the artisan. All such modifications and embodiments as may readily occur to one skilled in the art are intended to be within the scope of the appended claims.

What is claimed is:

1. An apparatus for developing a latent image recorded on a surface, comprising:

wire supports;

a donor member spaced from the surface and being adapted to transport toner to a region opposed from the surface;

an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and a low surface energy inorganic material coating on at least a portion of nonattached regions of said electrode member.

2. An apparatus in accordance with claim 1, wherein said low surface energy of said low surface energy material is from about 10 to about 25 dynes/cm.

3. An apparatus in accordance with claim 2, wherein said inorganic coating is borosilicate glass.

4. An apparatus in accordance with claim 2, wherein said inorganic coating is selected from the group consisting of diamond and diamond derivatives.

5. An apparatus in accordance with claim 2, wherein said inorganic coating is molybdenum silicide.

6. An apparatus in accordance with claim 1, wherein said inorganic coating comprises a material selected from the group consisting of ceramics, borosilicate glass, diamond, $MoS_2$ and derivatives thereof.

7. An apparatus in accordance with claim 6, wherein said inorganic coating is a ceramic material selected from the group consisting of boron nitride, zirconium oxide, titanium carbide, silicon carbide, titanium nitride, zirconium diboride, and yettrium oxide.

8. An apparatus in accordance with claim 1, wherein said inorganic coating comprises an electrically conductive filler dispersed therein.

9. An apparatus in accordance with claim 8, wherein said electrically conductive filler is selected from the group consisting of carbon black, metal oxides, and metal hydroxides.

10. An apparatus in accordance with claim 9, wherein said conductive metal filler is selected from the group consisting of tin oxide, titanium oxide, zirconium oxide, calcium hydroxide, and magnesium hydroxide.

11. An apparatus in accordance with claim 9, wherein said electrically conductive filler is carbon black.

12. An apparatus in accordance with claim 1, wherein said inorganic coating is present on from about 10 to about 90 percent of said electrode member.

13. An apparatus in accordance with claim 1, wherein said inorganic coating is of a thickness of from about 1 $\mu$m to about 5 $\mu$m.

14. An apparatus in accordance with claim 1, wherein said electrode member includes more than one thin diameter wires.

15. An apparatus in accordance with claim 1, wherein said thin diameter wires have a diameter of from about 50 to about 100 $\mu$m.

16. An apparatus in accordance with claim 1, wherein said donor member is closely spaced from said donor member a distance of from about 0.001 to about 45 $\mu$m.

17. An apparatus in accordance with claim 1, wherein said inorganic coating material is coated on said electrode wire by dip coating.

18. An apparatus in accordance with claim 17, wherein said dip coated inorganic coating material is cured at a temperature of from about 400 to about 1,400° C.

19. An electrophotographic process comprising:

a) forming an electrostatic latent image on a charge-retentive surface;

b) applying toner in the form of a toner cloud to said latent image to form a developed image on said charge retentive surface, wherein said toner is applied using a development apparatus comprising wire supports; a donor member spaced from the surface and being adapted to transport toner to a region opposed from the surface; an electrode member positioned in the space between the surface and said donor member, said electrode member being closely spaced from said donor member and being electrically biased to detach toner from said donor member thereby enabling the formation of a toner cloud in the space between said electrode member and the surface with detached toner from the toner cloud developing the latent image, wherein opposed end regions of said electrode member are attached to said wire supports adapted to support the opposed end regions of said electrode member; and a low surface energy inorganic coating on at least a portion of nonattached regions of said electrode member;

c) transferring the toner image from said charge-retentive surface to a substrate; and d) fixing said toner image to said substrate.

20. An apparatus for developing a latent image recorded on a surface, comprising:

wire supports;

a donor member spaced from the surface and being adapted to transport toner to a region opposed from the surface;

an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and a low energy surface inorganic material coating on at least a portion of nonattached regions of said electrode member, wherein said low surface energy material has a low surface energy of from about 10 to about 25 dynes/cm.

* * * * *

UNITED STATES PATENT AND TRADEMARK OFFICE

CERTIFICATE OF CORRECTION

PATENT NO. : 5,805,964

DATED : 9/8/98

INVENTOR(S) : Badesha et al.

It is certified that error appears in the above-identified patent and that said Letters Patent is hereby corrected as shown below:

Column 14, line 50, delete "low energy surface" and replace with --low surface energy--.

Signed and Sealed this

Twenty-third Day of February, 1999

*Attest:*

Q. TODD DICKINSON

*Attesting Officer*

*Acting Commissioner of Patents and Trademarks*